US006251480B1

(12) United States Patent
Jackson

(10) Patent No.: US 6,251,480 B1
(45) **Date of Patent: *Jun. 26, 2001**

(54) DECORATIVE SURFACE TREATMENT APPARATUS AND METHOD

(75) Inventor: Susan A. Jackson, Plymouth, MN (US)

(73) Assignee: Wagner Spray Tech Corporation, Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/165,767

(22) Filed: Oct. 2, 1998

(51) Int. Cl.[7] ..... B05D 1/28

(52) U.S. Cl. ..... 427/260; 427/261; 427/262; 427/428; 427/429

(58) Field of Search ..... 427/428, 429, 427/267, 261, 262, 260; 15/230.11–230.12; 118/244

(56) References Cited

U.S. PATENT DOCUMENTS

| | | | | |
|---|---|---|---|---|
| D. 220,850 | * | 6/1971 | Davis . | |
| 278,212 | * | 5/1883 | Birge | 427/428 |
| 647,833 | * | 4/1900 | Henricus | 427/428 |
| 1,487,039 | * | 3/1924 | Suhr | 427/428 |
| 1,625,690 | * | 4/1927 | Swanfeldt | 427/428 |
| 1,809,146 | * | 6/1931 | Ross | 427/428 |
| 1,810,145 | * | 6/1931 | Ross | 427/428 |
| 2,161,223 | * | 6/1939 | Bener | 427/353 |
| 2,630,592 | | 3/1953 | Sultanik et al. . | |

(List continued on next page.)

FOREIGN PATENT DOCUMENTS

| | | | |
|---|---|---|---|
| 476613 | | 8/1951 | (CA) . |
| 191483 | | 9/1937 | (CH) . |
| 368875 | * | 2/1923 | (DE) . |
| 3616114 A1 | | 11/1987 | (DE) . |
| 526908 | * | 10/1920 | (FR) . |
| 2489175 | | 3/1982 | (FR) . |
| 9002-017 | | 4/1991 | (NL) . |
| 80213 | | 5/1952 | (NO) . |
| 694228 | | 12/1979 | (SU) . |

OTHER PUBLICATIONS

*Decorative Painting 81 Projects & Ideas for the Home*, The Home Decorating Institute; Cy DeCosse, Inc. 1994 pp. 88–117.

*Color—A Stroke of Brilliance, A Guide to Color & Decorating with Paint*; Leslie Harringont, Benjamin Moore & Co., 1993; pp. 104–107.

Advertising printouts—Web site for The Woolie™ found at http://www.Woolie.com© 1998, (6 pages).

* cited by examiner

*Primary Examiner*—Fred J. Parker
(74) *Attorney, Agent, or Firm*—Faegre & Benson, LLP

(57) ABSTRACT

An apparatus and method for creating a decorative treatment giving the illusion of depth to a surface, where the apparatus has a paint applicator roller and a roller cover. The roller cover has at least one raised foam pattern that is sized, shaped and positioned to substantially circumscribe the roller cover and create clearly defined edges along its periphery and a gap between adjacent edges of the foam pattern. The method including loading at least one coating onto the roller cover, the coating having at least one different visually perceptible characteristic than a finish of the surface to be coated, and applying the coating to the surface by moving the handle in a plurality of generally linear discrete motions. The decorative treatment resulting from the effect of a plurality of partially overlapping, semi-random pattern images formed on the surface by the coating applied to the surface using the raised foam pattern.

28 Claims, 12 Drawing Sheets

(2 of 12 Drawing Sheet(s) Filed in Color)

U.S. PATENT DOCUMENTS

| | | | | |
|---|---|---|---|---|
| 2,863,245 | | 12/1958 | Knapp, Jr. . | |
| 3,372,493 | * | 3/1968 | Birch | 427/260 |
| 4,109,665 | * | 8/1978 | Godfrey, Jr. et al. | 131/15 C |
| 4,191,792 | | 3/1980 | Janssen . | |
| 4,201,801 | * | 5/1980 | Hori . | |
| 4,257,140 | | 3/1981 | Downing . | |
| 4,293,599 | * | 10/1981 | Hori et al. | 427/428 |
| 4,294,187 | * | 10/1981 | Fogle | 427/428 |
| 4,404,703 | | 9/1983 | Woodall, Jr. et al. . | |
| 4,434,521 | | 3/1984 | Martin et al. . | |
| 4,630,952 | | 12/1986 | Elbaum . | |
| 4,919,975 | | 4/1990 | Jones . | |
| 4,930,179 | | 6/1990 | Wright et al. . | |
| 5,117,529 | | 6/1992 | Ohta . | |
| 5,206,979 | | 5/1993 | Campbell . | |
| 5,354,596 | * | 10/1994 | Chew et al. | 427/430.1 |
| 5,471,703 | | 12/1995 | Niven . | |
| 5,571,562 | | 11/1996 | Wakat . | |
| 5,577,291 | | 11/1996 | Myers et al. . | |
| 5,620,772 | * | 4/1997 | Taniguchi | 427/387 |
| 5,693,141 | | 12/1997 | Tramont | 118/211 |
| 5,713,095 | * | 2/1998 | Wakat . | |
| 5,866,206 | * | 2/1999 | Jennings-Tolchiner | 427/260 |

DECORATIVE SURFACE TREATMENT APPARATUS AND METHOD

This invention relates to apparatus and methods for creating a decorative treatment on a surface.

BACKGROUND OF THE INVENTION

The creation of faux finishes and other decorative surface treatments on objects and surfaces has been achieved in the past by various methods. These methods have proven to be time consuming and tedious due to the necessity of carrying out multiple steps to achieve the desired aesthetic effect. As a result, the cost of obtaining these surface treatments may be prohibitively high, or require an excessive time commitment on the part of the painter.

Examples of such surface treatments include faux marble finishes, giving a surface the appearance of being marble, and faux texture finishes, giving the surface the appearance of depth or texture. Both of these faux finishes are aesthetically desirable, but expensive and time consuming to produce by known methods. Faux marble methods usually include applying multiple sponge painted layers of paint over the surface or object, usually with drying time required between each successive layer. After the sponge painting is complete, applying random line-type marks is typically accomplished by feather painting techniques to produce a "veined" appearance often found in marble. Faux texture methods usually include applying multiple layers of paint or other coating over the surface or object using various techniques known in the art, usually with drying time required between each successive layer. For example, a faux texture finish giving the appearance of overlapping leaves would require the application of numerous layers of leaf images, as well as the creation of blended areas and other subtle effects.

Other decorative painting or coating type surface treatments include stenciling, stamping, texturizing, sponging, rag rolling, speckling, and combing. All of these techniques require extensive time, training, and/or expensive professional help.

Other methods of achieving decorative surface treatments include the application of decorative wallpaper. However, the use of wallpaper also has its problems, including being expensive, time consuming to install, having a short life span, and lacking the randomness of a true finish.

SUMMARY OF THE INVENTION

The present invention overcomes these shortcomings by providing an apparatus and method for creating decorative surface treatments, such as those giving the illusion of depth to a surface, using a simple, hand held paint applicator. This apparatus is a roller paint applicator having one roller mounted for independent rotation. The roller has at least one raised foam pattern on it. Use of the present invention simplifies the method of producing decorative surface treatments, especially those creating an illusion of depth on the surface, by reducing the steps needed. These steps include applying a paint, but preferably more than one paint, to the applicator roller, and then applying the paint to the surface to be coated using the applicator in a discrete but overlapping motion. This method greatly reduces the time and complexity of the prior methods, thereby also reducing the cost and other barriers to obtaining such a finish, as well as the amount of effort and time needed for cleanup.

BRIEF DESCRIPTION OF THE DRAWINGS

The file of this patent contains at least one drawing executed in color. Copies of this patent with color drawings will be provided by the Patent and Trademark Office upon request and payment of necessary fee.

DETAILED DESCRIPTION

Figure 1:
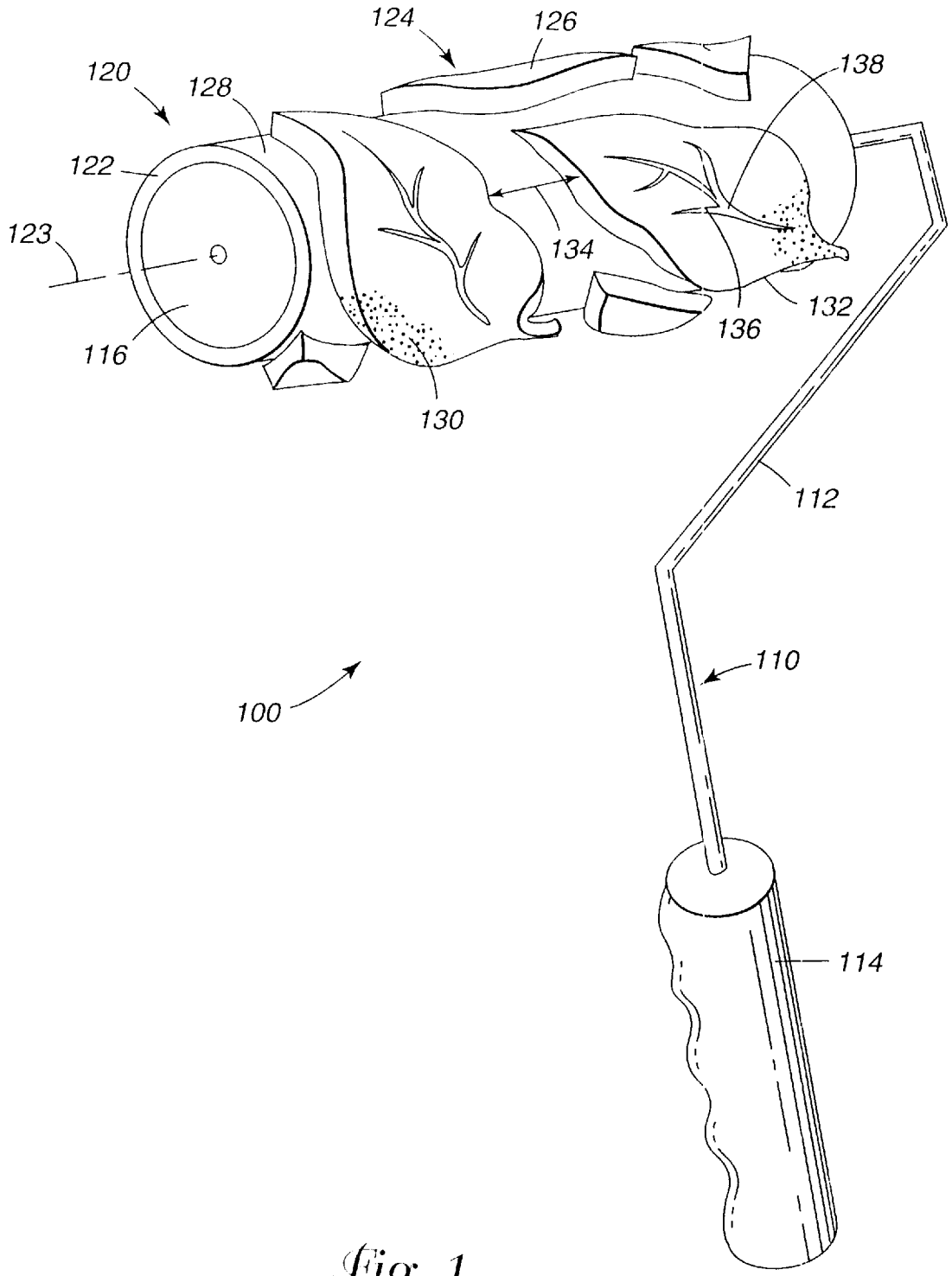
FIG. 1 is a perspective view of a roller paint applicator useful in the practice of the present invention.

With reference to the attached Figures, it is to be understood that like components are labeled with like numerals throughout the several Figures. FIG. 1 illustrates a roller paint applicator 100 useful in the present invention for creating a decorative surface treatment on a surface. As used herein, a decorative surface treatment is a surface treatment that produces the illusion of qualities not inherent to the surface, in particular, but not limited to depth. The roller paint applicator 100 includes a roller handle 110 and a roller mechanism 116 mounted for independent rotation. The roller handle 110 includes a grip 114 and a L-shaped shaft 112 to which the roller mechanism 116 is mounted.

A roller cover 120 is mounted on the roller mechanism 116 to complete the roller paint applicator 100. The roller cover 120 includes a core 122 and a foam layer 124, and is preferably removable and interchangeable to allow for versatility in the use of the roller paint applicator 100 and ease of cleanup.

The core 122 may formed from a number of materials, including, but not limited to paper, cardboard, phenolic, or plastic, such as PVC. The core 122 may be disposable or reusable, but preferably is capable of being used and washed enough times to allow for at least the complete application of a decorative surface treatment to an entire reasonably sized room. The core 122 can be sized to meet application requirements, both in length and diameter, however ease of use can provide practical limitations on size. For example, if the core 122 is too large, the weight of a roller applicator when loaded with paint can pose fatigue and control problems for the user. If, on the other hand, the core 122 is too small, the amount of surface area coverage is limited, thus requiring more time and effort to produce a decorative surface treatment on an entire surface. Preferably, the core 122 will be sized between 4 and 7 inches in length, and 1.5 to 1.75 inches in diameter. The thickness of the core 122 can vary depending on the strength of the material chosen. Preferably, however, the thickness will follow industry standards in the range of about 1/16 to 1/8 inches.

The foam layer 124 is preferably formed from a foam having particular qualities that allow for accurate transfer of designs from the roller cover to the surface. Preferably, the foam is an open cell foam that is capable of absorbing a desired quantity of paint or other coating, is flexible in order to form around the roller cover core 122, and is capable of transferring clear, well-defined images from the foam layer 124 to a surface. A preferred foam is a flexible urethane foam having a density in the range of about 4.5 to about 5.5 pounds per cubic foot. An example of a suitable foam is Carpenter Foam # O50XY, produced by Carpenter Co., 195 County Road 15 South, P.O. Box 2386, Elkhart, Ind. 46518. The thickness of the foam layer 124 can vary depending on the decorative surface treatment desired, but is preferably in the range between about 0.25 and about 0.5 inches.

Although a standard L-shaped shaft type roller paint applicator 100 is shown, the present invention is not limited to this specific roller paint applicator design. Any other type of roller paint applicator, now known or later designed, providing independent rotational mounting for at least one roller cover is also contemplated for use with the present invention.

The foam layer 124 of the roller cover 120 may be formed into foam patterns to produce different decorative surface treatments. A number of specific foam patterns are described below representing different pattern possibilities. The method of creating a decorative surface treatment using these foam patterns and the roller paint applicator 100 is then discussed, and the decorative surface treatments resulting from the specific foam patterns are described.

Figure 2:
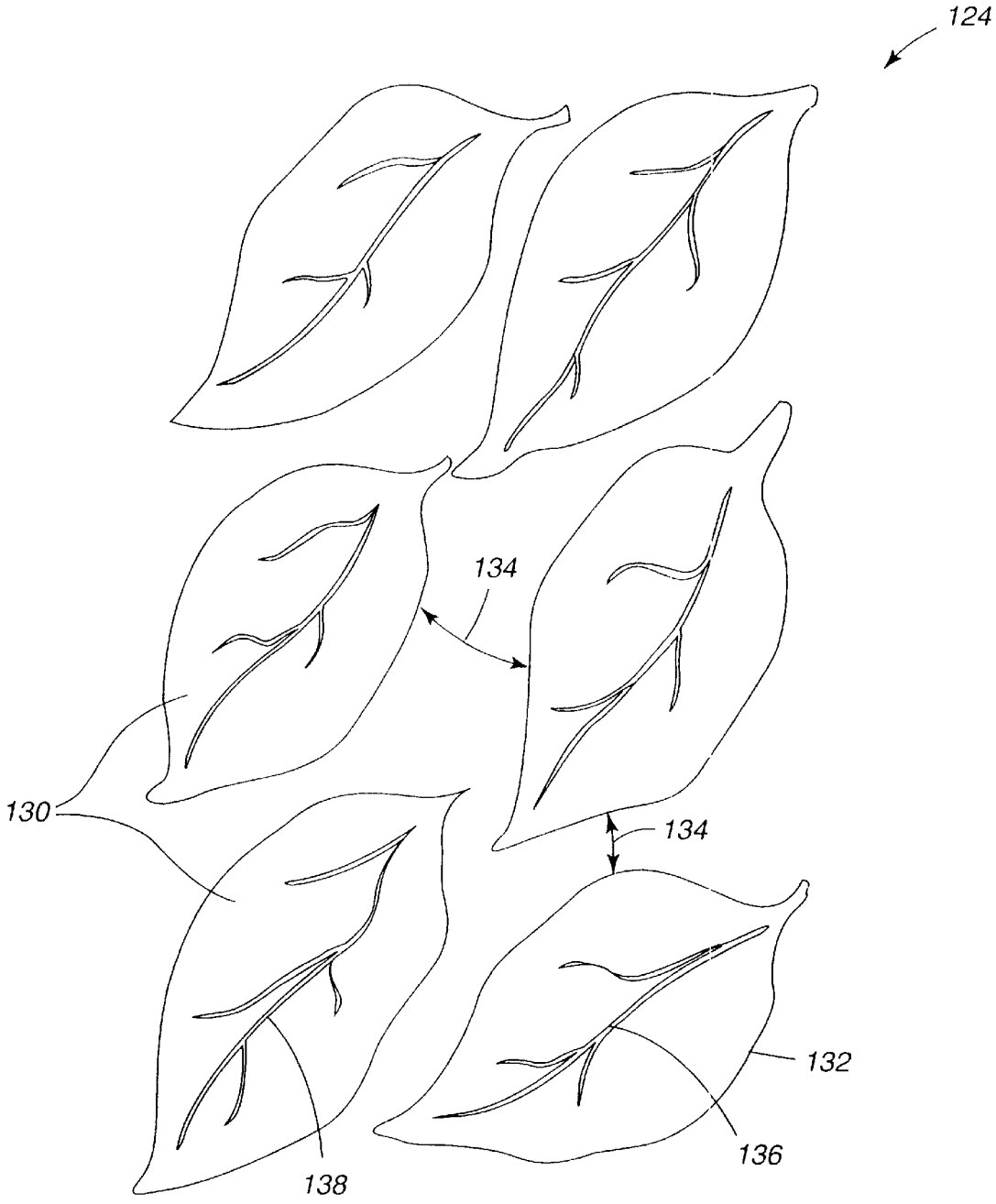
FIG. 2 is a plan view of the raised foam pattern of the roller cover of FIG. 1 as it would appear in a plane.

FIGS. 1 and 2 illustrate one embodiment of a roller cover 120 comprising a core 122 and a foam layer 124 formed into multiple foam patterns 130. The multiple foam patterns 130 are each preferably shaped to represent an aspen leaf with a unique, natural looking periphery 132. The foam layer 124 is preferably smoothly wrapped around and attached to the core 122 so that the core 122 is substantially covered by the foam layer 124. The foam layer 124 is positioned on the core 122 to leave side regions 128 of the core 122 free of foam. Foam free side regions 128 facilitate packaging and storage, as well as help reduce wear and tear on the exposed edges of the foam layer 124. The aspen leaf shape of the patterns 130 and the orientation of the patterns 130 on the core 122 result in a general non-contacting engagement of the foam patterns 130 when the foam layer 124 is wrapped about the core 122. This engagement allows the foam pattern 130 to extend around the core 122 without the foam layer 124 overlapping itself into a double layer of foam material. As a result of such engagement of the patterns 130, the periphery 132 of the foam patterns 130 form a number of non-uniform gaps, representatively referenced as 134, that each partially wind about the core 122. In addition, each foam pattern 130 is provided with slits in the foam resulting in inner edges 136 representing leaf veins. The inner edges 136 form inner gaps 138 that stay devoid of paint when the roller cover 120 is loaded with paint.

The non-uniform gap 134 may range in width depending on the design, size and placement of the pattern 130 on the core 122. However, if the gap 134 is too small, the edges of the foam pattern 132 at the gap 134 are less effective to achieve the desired decorative surface treatment results. If the gap 134 is too large, excess paint or other coating may collect in the gap 134 and cause paint to blob, drip, and/or fling off the roller cover. The gap 134 preferably is not formed parallel to the axis 123 of the roller cover 120, but rather is preferably oriented generally along a spiral path about the core 122 to some extent. Gaps 134 that are formed generally parallel along the axis 123 of the roller cover 120 have been found to have a greater tendency to collect paint and fling it off the roller.

Figure 3:
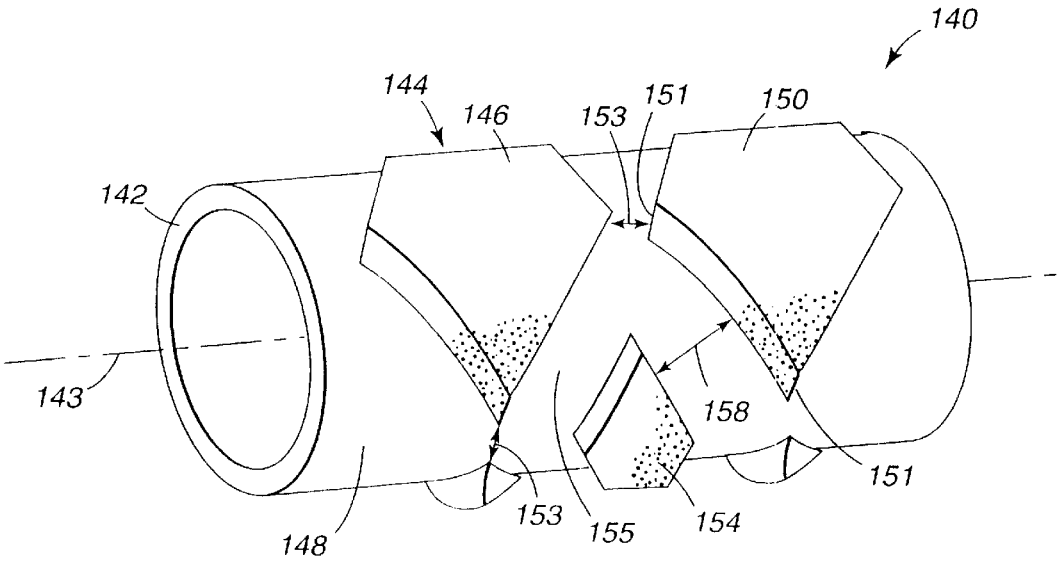
FIG. 3 is a perspective view of another roller cover useable with the roller paint applicator shown in FIG. 1, having a multiple diamond shaped foam pattern thereon.
Figure 4:
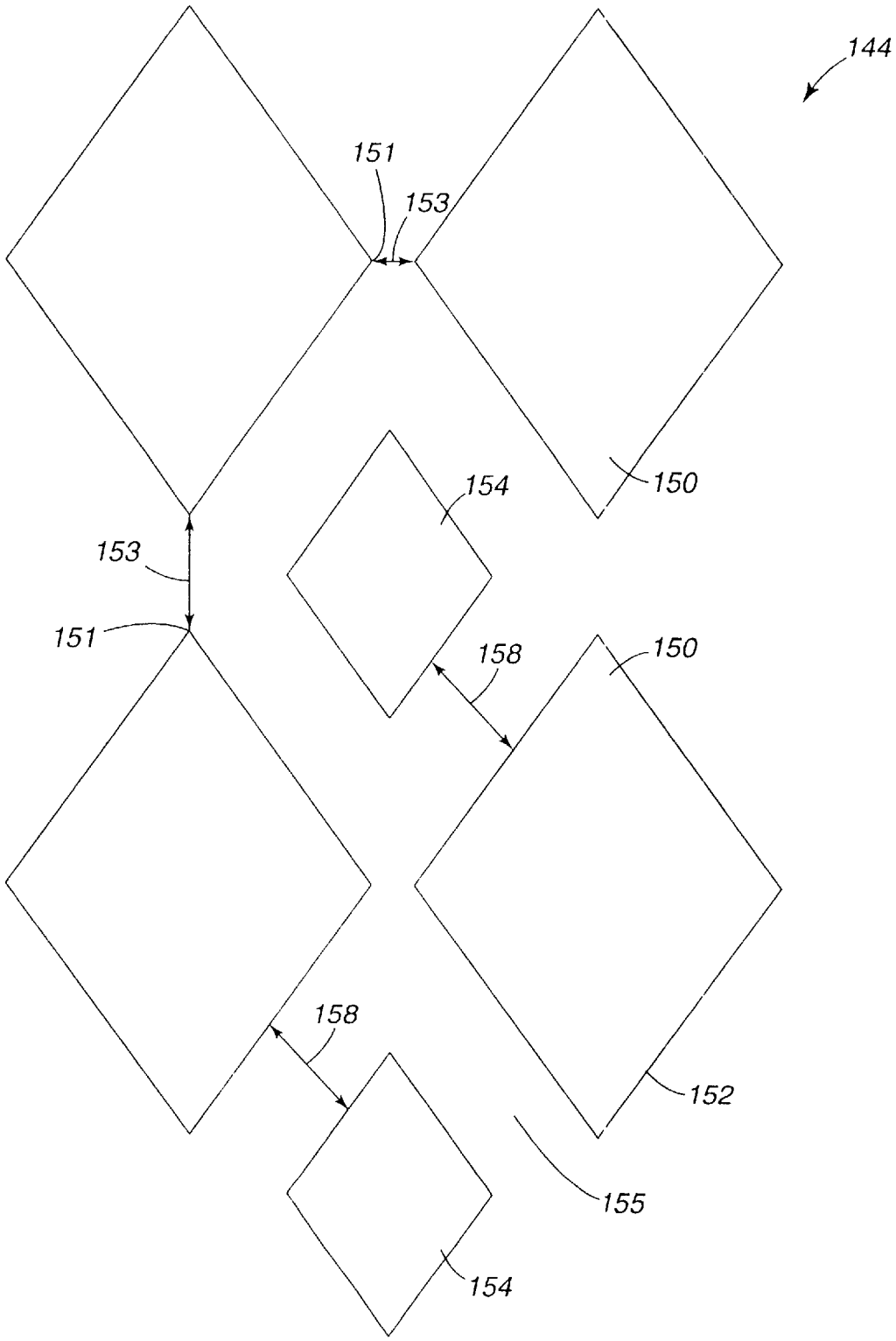
FIG. 4 is a plan view of the raised foam pattern of the roller cover of FIG. 3 as it would appear in a plane.

FIGS. 3 and 4 illustrate another embodiment of a roller cover 140 to be used on a roller paint applicator 100 such as that shown in FIG. 1. The roller cover 140 has a core 142 and a foam layer 144 that is formed into a plurality of geometric shaped patterns, including a large diamond pattern 150 and a small diamond pattern 154. In the same manner as the embodiment described above, the foam layer 144 is preferably smoothly wrapped around and attached to the core 142 so that the core 142 is substantially covered by the foam layer 144. Side regions 148 are also provided, in the same manner as the embodiment above. In this foam layer 144, the large diamond foam patterns 150 are aligned in two rows and two columns, and are spaced apart from each other forming gaps 153 between adjacent corners 151 of the diamond patterns 150. The alignment of the large diamond patterns 150 forms substantially diamond shaped openings 155 between the large diamond patterns 150. Small diamond patterns 154 are positioned in the middle of these openings 155 forming relatively uniform gaps 158 between the small diamond patterns 154 and the large diamond patterns 150. The placement of the foam patterns 150, 154 causes the foam patterns 150, 154 not to touch when the foam layer 144 is wrapped about the core 142. As a result of the positioning of the foam patterns 150, 154, the gaps 153, 158 formed between the foam patterns 150, 154 zigzag about the core 142, thus preventing the gaps 153, 158 from following a less desirable path parallel to the axis 143 of the roller cover 140.

Figure 13:
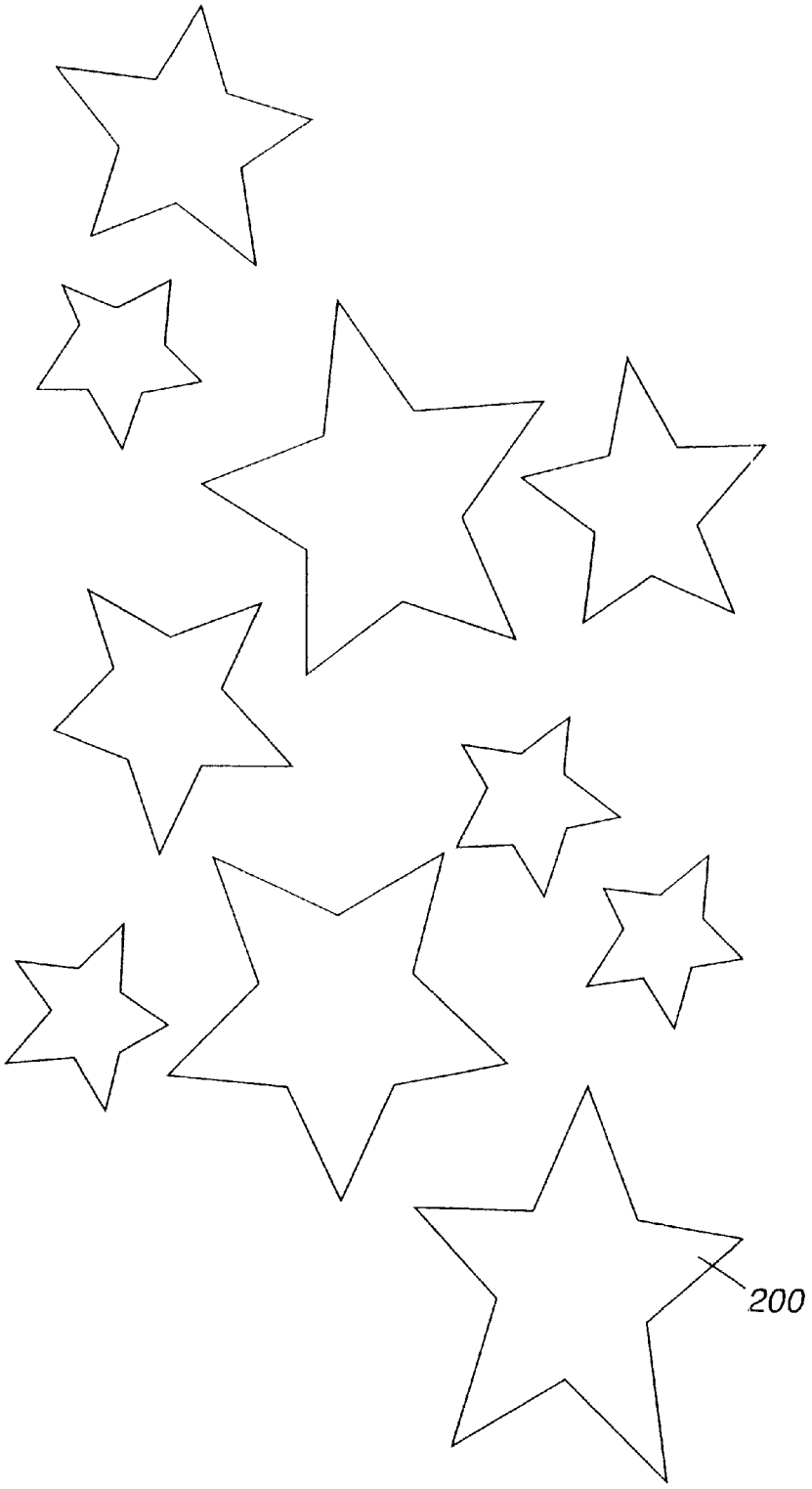
FIG. 13 is an illustration of a geometric foam pattern design in the shape of stars.
Figure 14:
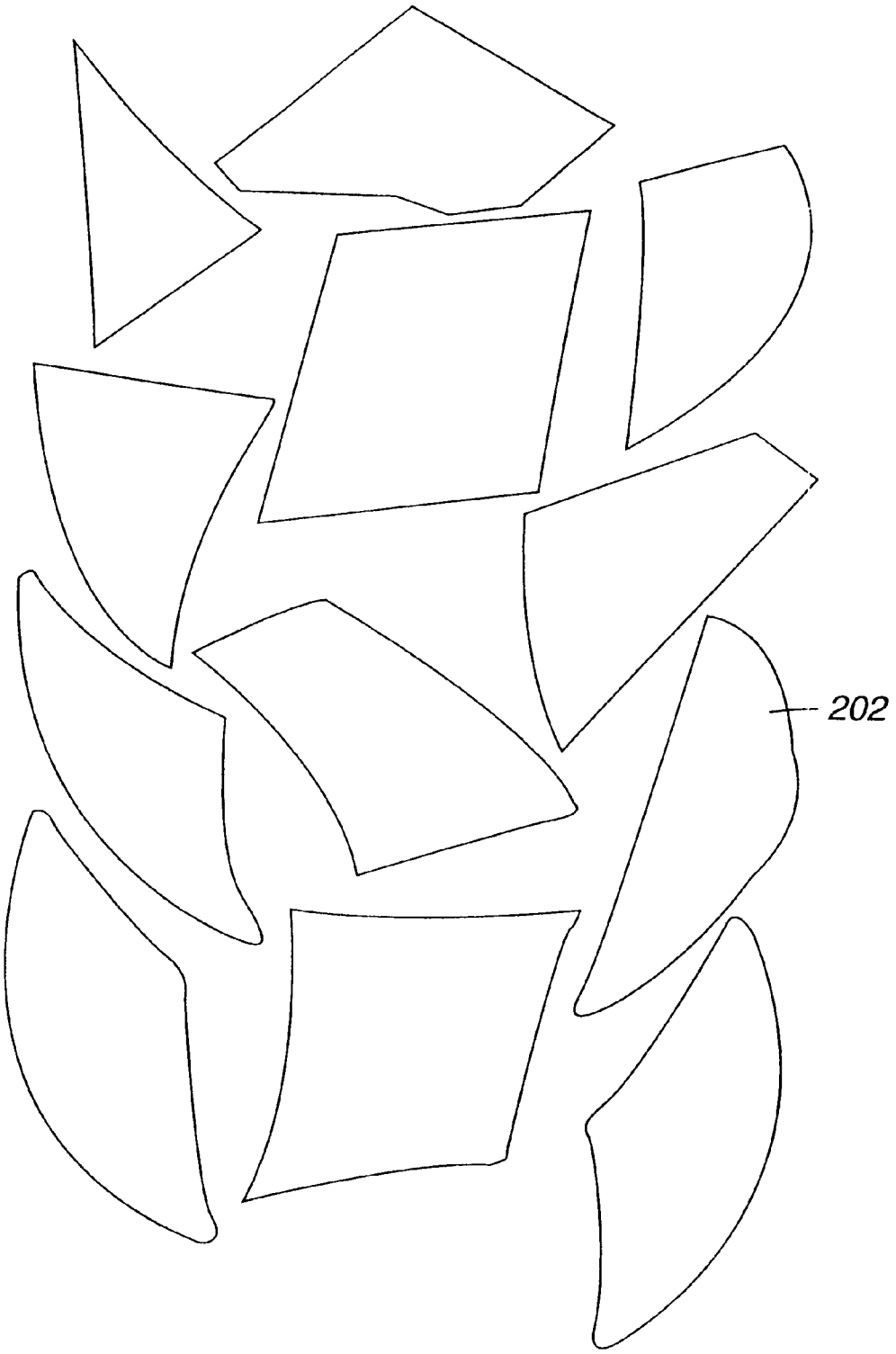
FIG. 14 is an illustration of an abstract foam pattern design having multiple small mosaic-like shapes.
Figure 15:
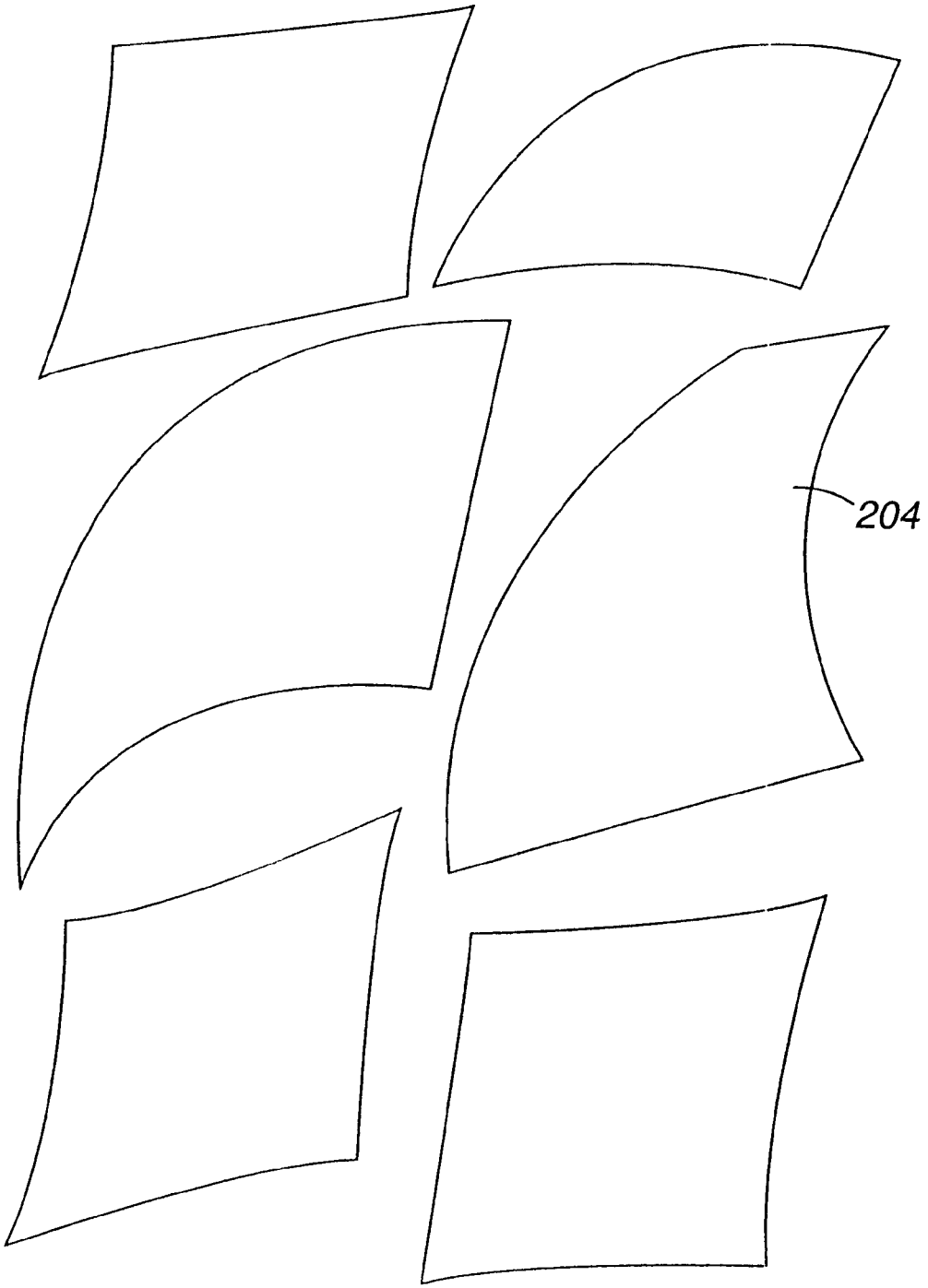
FIG. 15 is an illustration of another abstract foam pattern design having multiple larger mosaic-like shapes.

The first embodiment described above having an aspen leaf shaped foam pattern 130 is representative of the many natural designs possible for roller cover foam patterns. FIGS. 8–12 illustrate other natural designs, including a maple leaf pattern 190, an ivy pattern 192, a joined twig pattern 194, a disjointed twig pattern 196, and a stone pattern 198, respectively. The second embodiment described above having multiple diamond shaped patterns 150, 154 is representative of the many geometric designs possible for roller cover foam patterns. FIG. 13 illustrates another such design, a star shaped pattern 200. In addition, abstract designs are useable for rolled cover foam patterns of the present invention. FIGS. 14–15 illustrate two such designs, a small, multiple mosaic-like design 202 and a larger, multiple mosaic-like design 204, respectively.

The creation of a decorative surface treatment on a desired surface under the present invention requires the application of a coating, in particular but not limited to paint, (hereinafter referred to as paint), to the desired surface by a roller paint applicator 100, as shown in FIG. 1, that includes a desired roller cover 120. The roller cover 120 of the roller paint applicator 100 facilitates the smooth application of at least one paint to the desired surface. The chosen paint must have at least one different visually perceptible characteristic than that of the visually perceptible finish of the surface to be decorated. These characteristics can include hue, intensity, saturation, luminescence, shade, tint, glossiness, pearlescence, or other visually perceptible phenomena. Although the decorative surface treatment may be achieved using one paint on a surface, it is preferable to apply at least two paints having different visually perceptible characteristics simultaneously with the roller paint applicator 100. Multiple paints may be applied with the single roller cover by a number of techniques, including drizzling additional paint or paints into a container of an initial paint, loading the roller cover with one paint from one container and then another paint from another container, or placing different paints side-by-side in a single container and loading the roller cover simultaneously from both paints.

The first step in producing the decorative surface treatment on the desired surface is the application of the paint, or paints, to the roller cover 120 on a roller paint applicator 100. This step may be referred to as loading the roller cover with paint. A standard paint pan, multi-compartment paint pan, separate paint pans, or other appropriate means known in the art, may be used to accomplish this step of the process. The foam layers 124 of the roller cover 120 absorb some of the paint, thus allowing for subsequent application of the paint to the desired surface. Excess paint should be rolled off the roller cover 120, and paint collected in the gaps 134 is preferably removed.

The second step of the process is the application of the paint on the roller cover 120 to the desired surface. This application occurs by contacting the foam layer 124 of the roller cover 120 of the roller paint applicator 100 with the desired surface, such as a surface to be coated 160 shown in FIG. 5. The paint on an outer surface 126 of the foam layer 124 transfers from the foam pattern 130 to the surface 160 on contact producing painted images 161 in the shape of the foam pattern 130. Paint absorbed into the foam layer 124 transfers to the surface upon application of pressure between the roller cover 120 and the surface 160.

Figure 5:
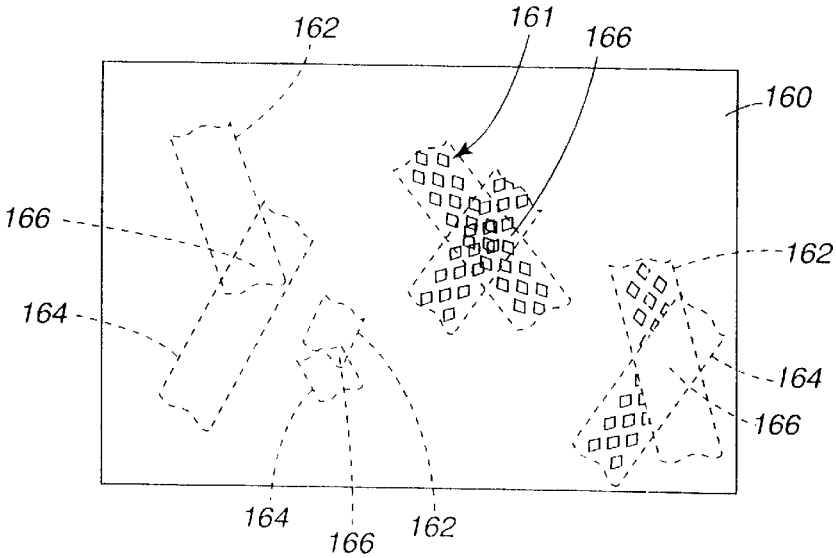
FIG. 5 is a plan view of a vertical surface such as a wall demonstrating one application technique using the apparatus of the present invention.

The roller paint applicator 100 is then moved about the surface 160 in substantially discrete motions. To achieve these discrete motions, the roller cover 120 on the roller paint applicator 100 is placed against the surface 160 and rolled in a substantially straight line for a desired distance. The roller cover 120 is then removed from the surface 160 and again placed against the surface 160, starting in another place, or in the same place with a different orientation, or in a new place with a different orientation. As shown in FIG. 5, roller cover 120 produces paint bands 162, 164 (shown by dashed lines) as the roller cover 120 is moved about the surface 160. It is to be understood that, as used herein, "paint bands" refers to the area containing a segment or region of repeating pattern images 161, and not to a solidly filled-in area such as a stripe of paint, as can be seen in FIG. 5. Although all of the paint bands 162, 164 contain pattern images 161, only a few representative pattern images 161 are shown. The paint bands 162, 164 may vary in length depending on the decorative surface treatment desired by the user. As the roller cover 120 is moved about the surface 160, the paint bands 162, 164 produced by the roller cover 120 preferably overlap to some extent as shown at locations 166. Even though there is an overlap, since the roller cover 120 is not moving back and forth over an area of the surface 160 numerous times, the paint applied to the surface 160 in the overlapping areas 166 does not blend, but instead produces clear pattern images 161 overlaid upon one another. The paint bands 162, 164 may be overlapped as many times as is desired, however, it is preferred to limit the maximum number of overlaps to only a few in order to prevent the pattern images 161 from blending or merging. The discrete motions producing some overlapping pattern images 161 are repeated across the portion of the surface 160 on which a decorative surface treatment is desired. The roller cover 120 is reloaded with paint as needed. The surface 160 may be entirely covered by the decorative surface treatment, or only a portion, or portions, of the surface 160 may be treated. Although the preferred decorative surface treatment requires some overlapping of the paint bands to achieve the desired results, another technique available with the roller cover and roller paint applicator of the present invention is the placement of discrete but non-overlapping pattern images on the surface in either a random or planned fashion.

As the roller cover 120 is loaded with paint and passed over the surface 160, the paint transfers from the surface 126 of the foam layer 124 onto the surface being coated 160. This transferred paint produces painted images 161 in the shape, size and design of the foam pattern 130 on the roller cover 120. These transferred pattern images 161 may be fully formed, such that the edges of each image are substantially complete and unbroken with the entire foam pattern design transferred to the surface, or they may be partially formed, depending on the extent the foam pattern 130 contacted the surface 160 during the roller application and the amount of paint then present in or on the foam. The images 161 may be substantially opaque, partially opaque, or have the appearance of being substantially translucent or transparent wherein the porous nature of the foam pattern 130 allows the background surface appearance to be seen through the pattern image. The nature of the resulting image 161 will depend on a number of factors, including the amount of paint loaded on to the roller cover 120, the pressure with which the roller cover 120 contacts the surface 160, and the speed at which the roller cover 120 is passed over the surface 160. The pressure with which the roller cover 120 contracts the surface 160 may be varied during a single, discrete pass, producing pattern images 161 ranging from opaque to translucent where desired. Although the painted pattern images 161 may be applied in a controlled and planned fashion, a more random application of images 161 using discrete motions is preferred to achieve a convincing illusion of depth on the surface. The resulting painted pattern images 161 will only be semi-random, however, due to the fixed arrangement of the foam patterns 130 on the roller cover 120.

Figure 6:
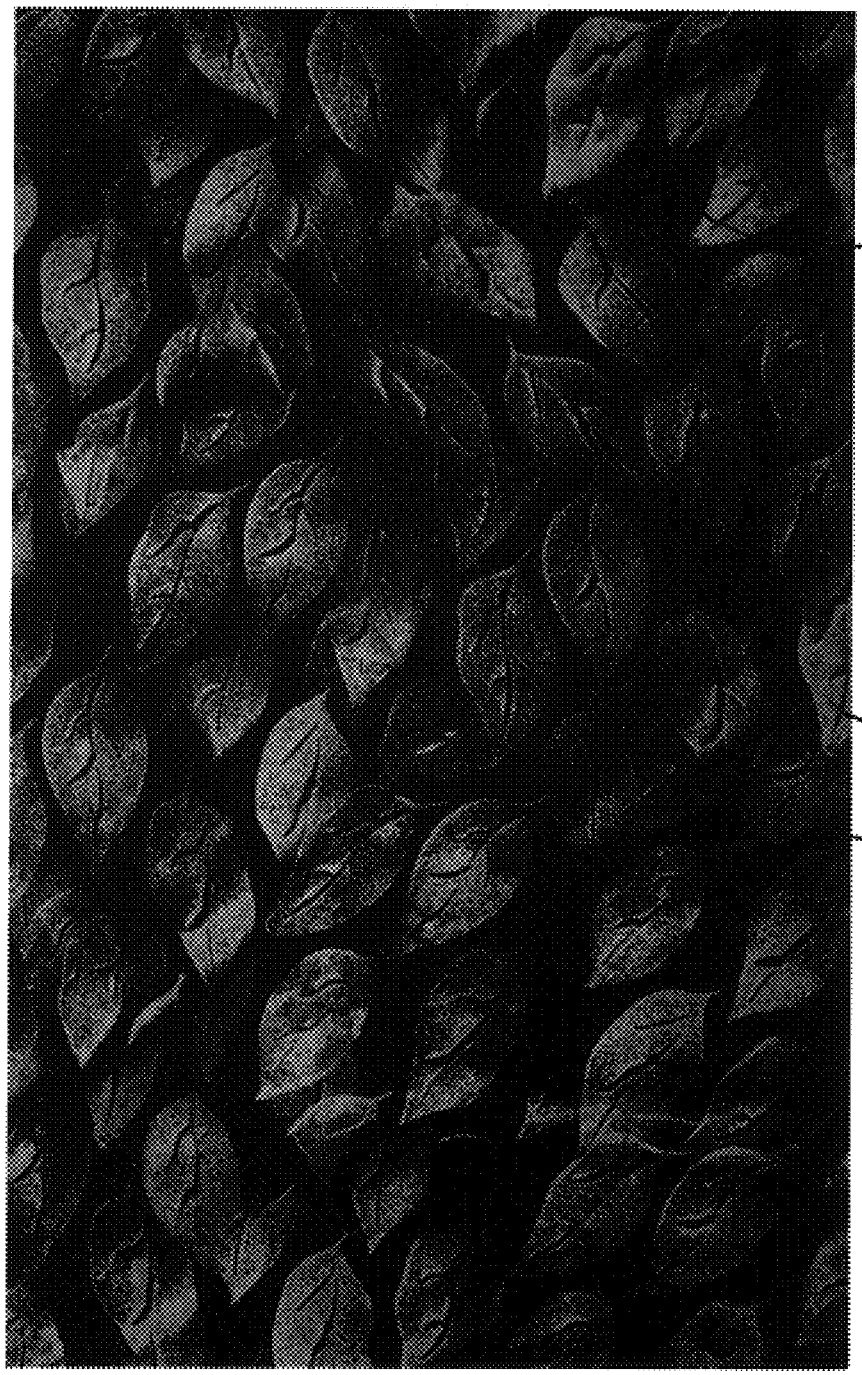
FIG. 6 is photograph/plan view of a surface upon which a decorative surface treatment has been applied by the apparatus of the present invention using the raised foam pattern of the type shown in FIG. 2.
Figure 7:
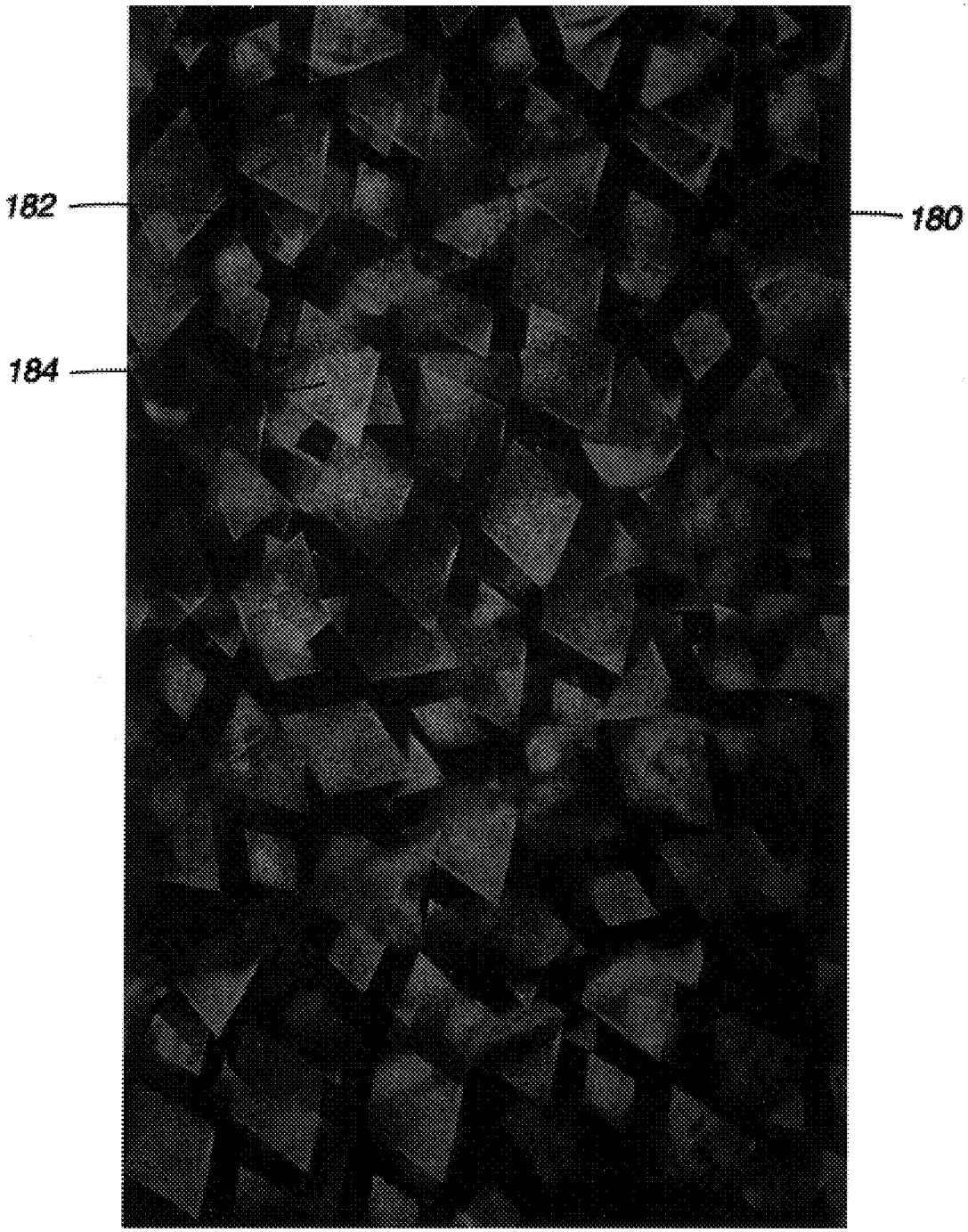
FIG. 7 is a photograph/plan view of a surface upon which a decorative surface treatment has been applied by the apparatus of the present invention using the raised foam pattern of the type shown in FIG. 3.
Figure 8:
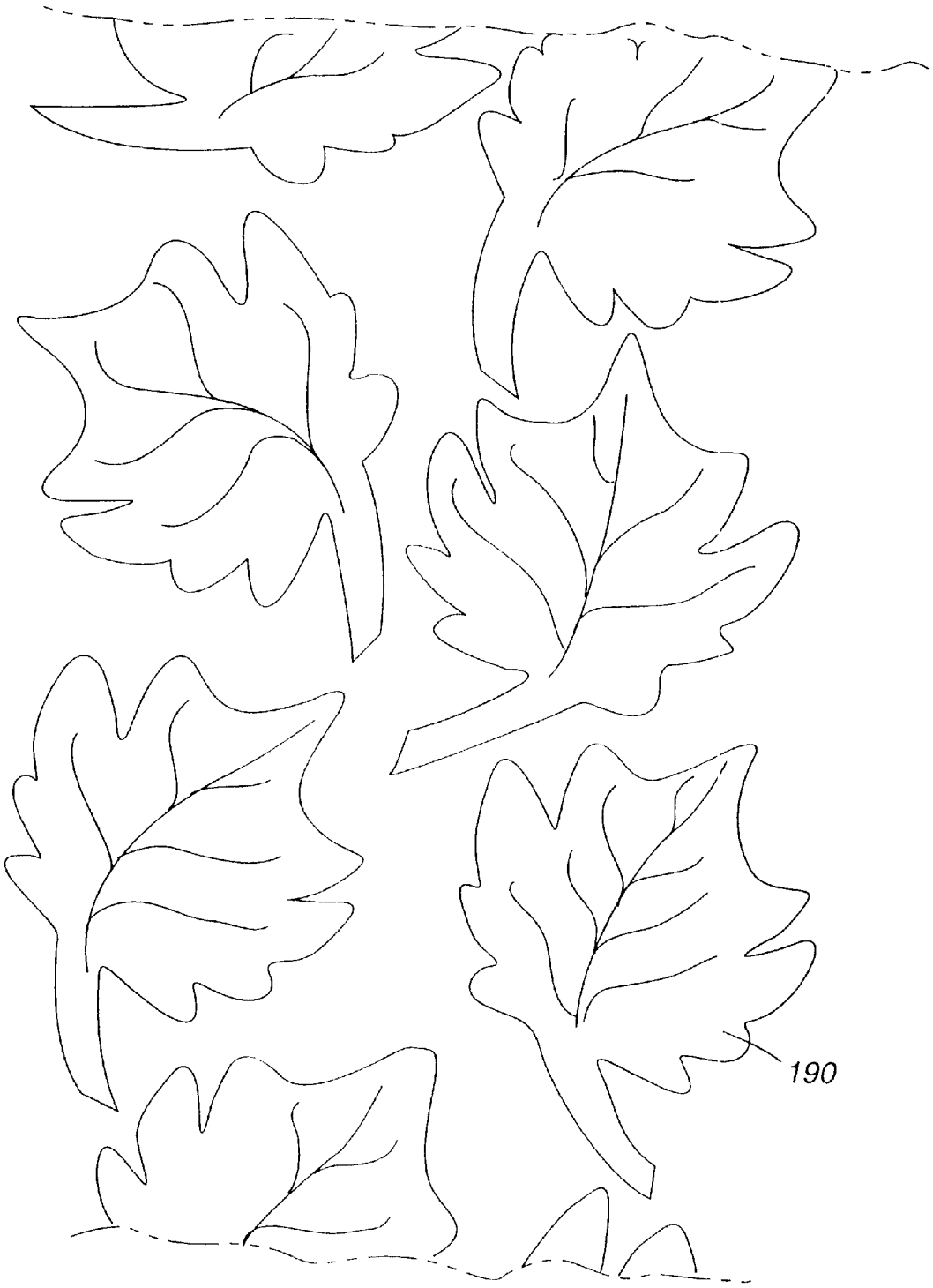
FIG. 8 is an illustration of a natural foam pattern design in the shape of maple leaves.
Figure 9:
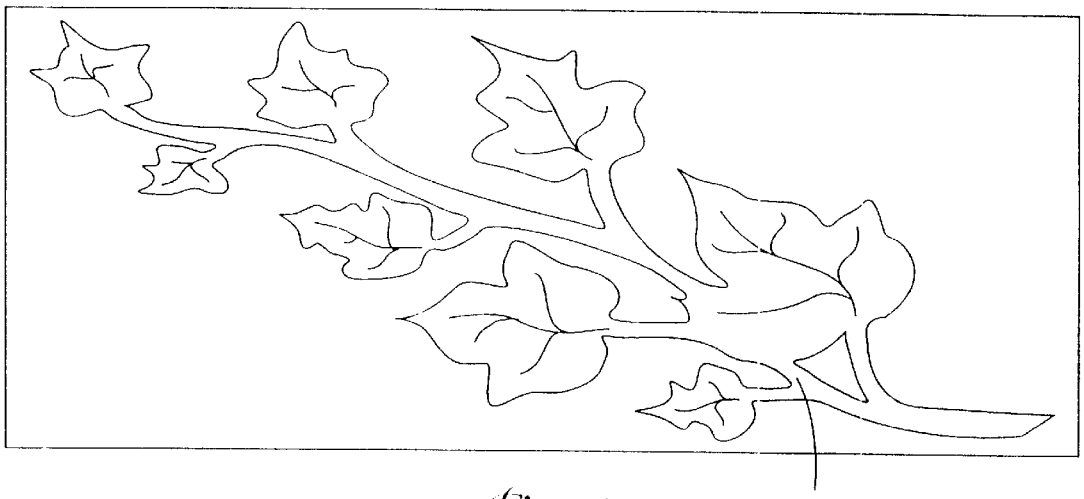
FIG. 9 is an illustration of another natural foam pattern design in the shape of ivy.
Figure 12:
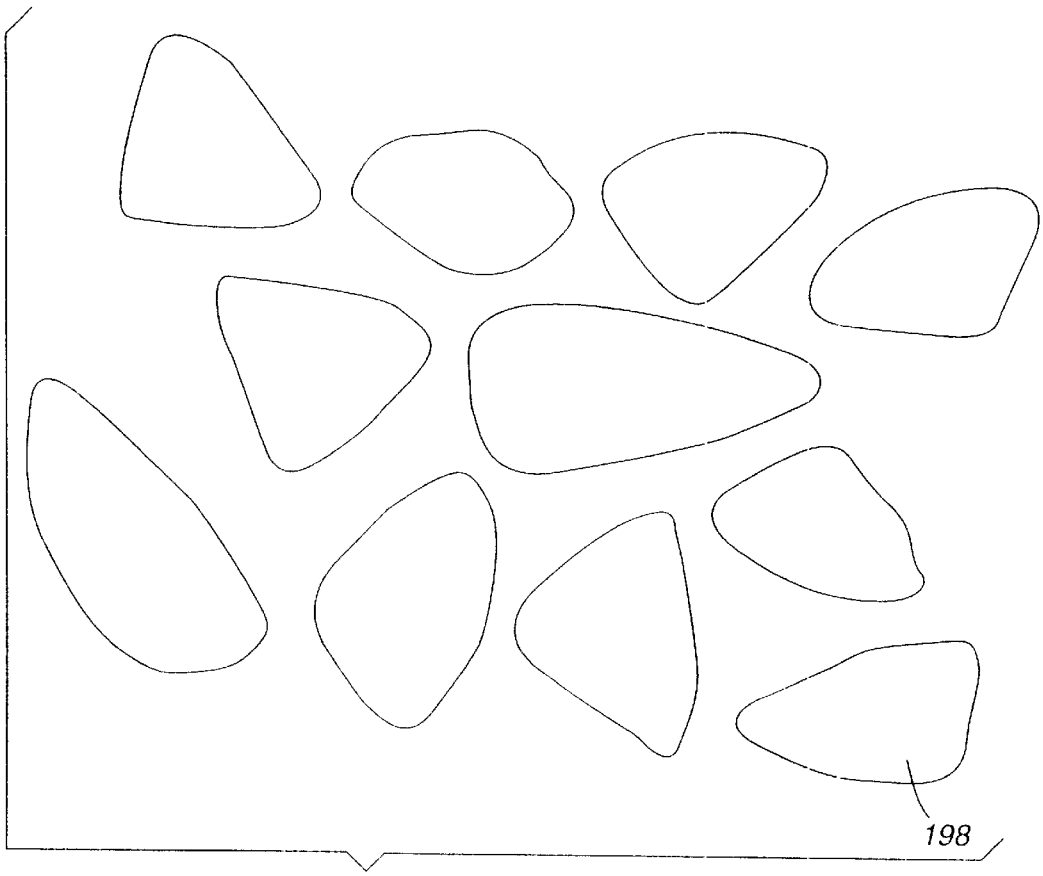
FIG. 12 is an illustration of yet another natural foam pattern design in the shape of stones.
Figure 11:
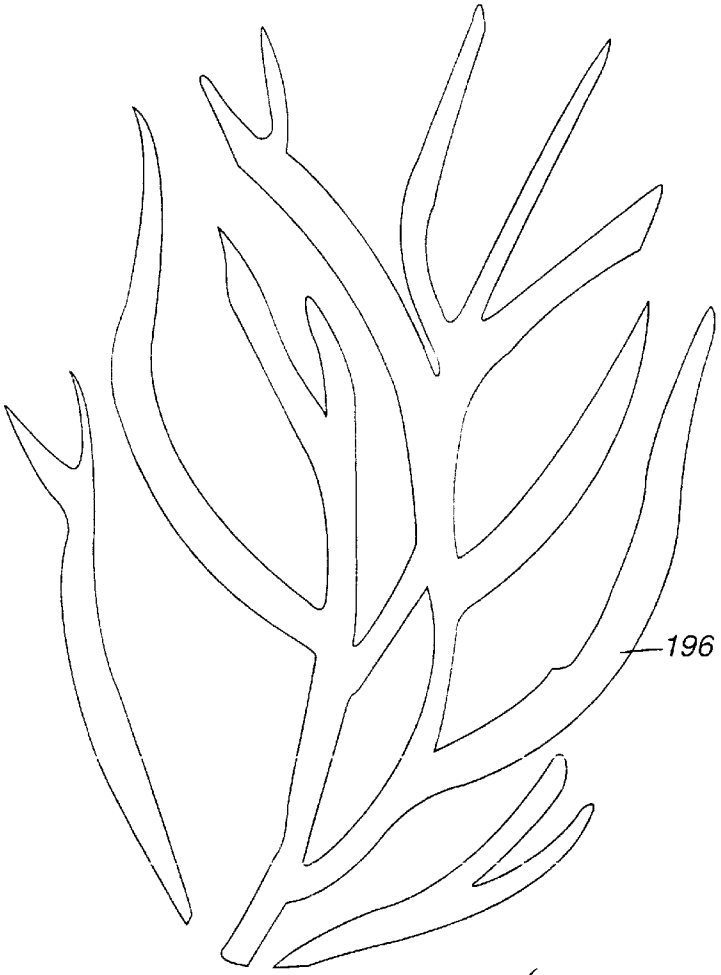
FIG. 11 is an illustration of another natural foam pattern design in the shape of disjointed twigs.
Figure 10:
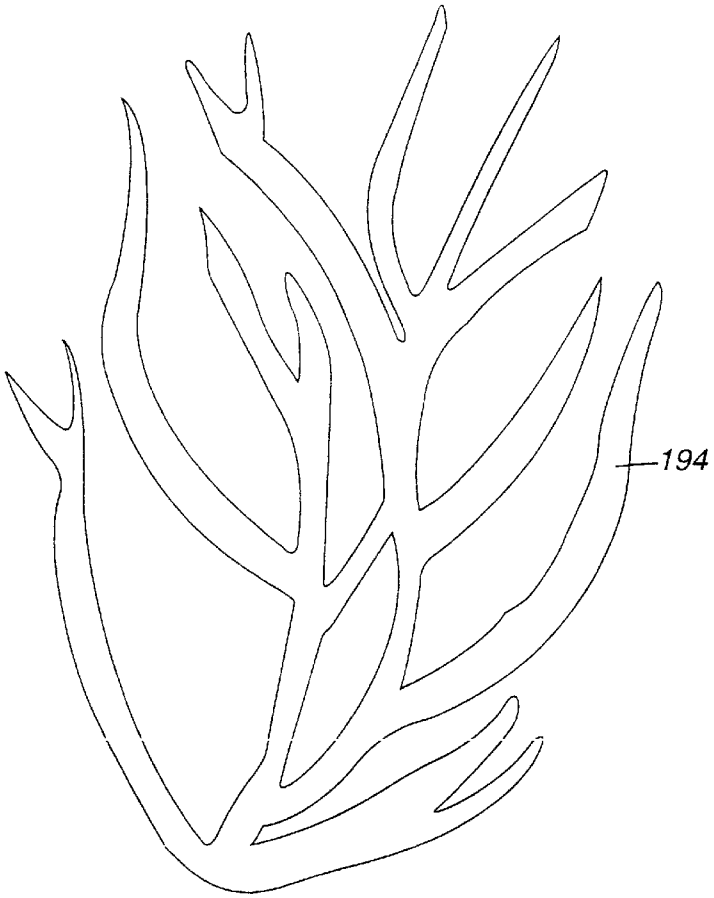
FIG. 10 is an illustration of another natural foam pattern design in the shape of joined twigs.

FIGS. 6 and 7 illustrate the resulting appearance of treated surfaces after using a roller paint applicator 100 having a roller cover 120 with the raised foam patterns 130, 150, 154 shown in FIGS. 2 and 4. The pattern images 172, 182, respectively, from the transferred paint are shown with overlapping image areas 174, 184, on surfaces 170 and 180.

The differences in visually perceptible characteristics between the paint on the roller cover 120 and the finish of the background surface 170, 180 cause the pattern images 172, 182 left by the foam patterns to be visible against the background surface 170, 180. The greater the difference in characteristic between the two paints, the more pronounced the pattern images 172, 182 become against the background surface 170, 180. The use of more than one paint on the roller cover 120 adds to the visual effect of the pattern images 172, 182, providing further definition to the pattern, added three dimensional character, and added visual appeal to the decorative surface treatment.

As shown in FIG. 6, the aspen leaf pattern 130 causes well-defined aspen leaf shaped pattern images 172 that are clear against the background surface 170. These aspen leaf images 172 include leaf veins produced by the absence of paint: transfer from internal gaps 138 in the foam pattern 130. In addition, overlapping image areas 174 are randomly provided. This distinct combination of leaf images 172 and overlapping leaf images 174, that range from opaque to translucent, overlaid upon the background surface 170, produces an aesthetically pleasing falling leaf appearance that gives the illusion of depth and three dimensional character to the surface 170.

As shown in FIG. 7, the multiple diamond patterns 150, 154 result in clearly defined dual-sized diamond pattern images 182 against the background surface 180. Overlapping diamond images 184 are also evident providing a somewhat random effect. This distinct combination of dual-sized diamond images 182 and overlapping diamond images 184, that range from opaque to translucent, overlaid upon the background surface 180, produces an aesthetically pleasing falling diamond appearance that gives the illusion of depth and three dimensional character to the surface 180. As used herein, "decorative surface treatment" means a three dimensional effect produced from a flat, rolled-on, partially overlapping, an apparently random pattern image applied to a contrasting finish on a surface.

The present invention has been illustrated by a few specific foam pattern designs each shown with one specific image representing a decorative surface treatment. It should be understood that the choice of paints or coatings, especially the difference in visually perceptible characteristic chosen and the characteristics of the background surface, combined with the application technique used by the user will affect the resulting decorative surface treatment provided by each foam pattern of the present invention. Each application will be unique, yet may be substantially similar to another application if the foam pattern and paints are the same. The user has the ability to manipulate the roller paint applicator to produce a decorative surface treatment having very defined pattern images, a surface treatment that is extremely subtle with only faint pattern images, or any variation in between. This ability of the user to manipulate the applicator to produce a decorative surface treatment to his or her liking makes the present invention extremely versatile and user friendly. No particular training is required, and the ease of use makes the invention readily available for use by consumers, instead of being limited only to professionals or trained individuals, as the prior surface treatment techniques have been. The apparatus of the present invention is easy to manufacture, and relatively inexpensive to produce, thereby making it a relatively inexpensive decorating option for consumers, that will produce professional quality and decorative results.

Although the present invention has been illustrated by a number of specific foam pattern designs, the invention is not to be taken as limited to only these designs. Any variation in foam pattern design that produces a decorative surface treatment as defined by the present invention are contemplated and within the scope of the present invention.

The invention is not to be taken as limited to all of the details thereof as modifications and variations thereof may be made without departing from the spirit or scope of the invention.

What is claimed is:

1. A method of creating a decorative treatment on a surface that gives the illusion of depth to the surface, comprising the steps of:

a) providing a paint applicator roller including a handle and a rotatable paint roller cover having a plurality of individual raised foam patterns thereon that are sized, shaped and positioned to substantially circumscribe the roller cover, each foam pattern having clearly defined edges along its periphery and an outer surface, with the foam patterns circumferentially spaced apart;

b) loading the foam patterns of the paint applicator roller with at least one coating material having at least one different visually perceptible characteristic than a finish of a surface to be treated; and c) applying the coating material to the finish of the surface as a plurality of partially overlapping, individual, pattern images that leave the finish of the surface at least partially visible, by rolling the roller cover across the finish of the surface to contact the finish of the surface with the foam patterns while the handle is moved in a plurality of partially overlapping, discrete motions, with at least some of the plurality of pattern images being substantially fully formed on the finish of the surface to substantially correspond in shape and size to the outer surfaces of the foam patterns on the roller cover and at least some of the plurality of pattern images being partially formed on the finish of the surface, the plurality of pattern images creating a decorative treatment on the finish of the surface that gives an illusion of three-dimensional depth to the finish of the surface.

2. The method of claim 1 wherein the at least one different visually perceptible characteristic is selected from among one or more of the group consisting of hue, intensity, saturation, luminescence, shade, tint, glossiness and pearlescence of the coating.

3. The method of claim 1 wherein at least two coating materials are applied to the surface simultaneously by the roller cover, each coating material having at least one different visually perceptible characteristic than both the finish of the surface and the corresponding characteristic of the other coating material.

4. The method of claim 1 wherein at least some of the plurality of pattern images are substantially opaque.

5. The method of claim 1 wherein at least some of the plurality of pattern images are partially opaque.

6. The method of claim 1 wherein at least some of the plurality of pattern images are substantially translucent.

7. The method of claim 1 wherein at least some of the plurality of pattern images are substantially transparent.

8. The method of claim 1 wherein the plurality of individual raised foam patterns are each shaped as a leaf pattern creating corresponding leaf-shaped pattern images on the surface with the decorative treatment having an appearance of falling leaves.

9. The method of claim 8 wherein the leaf shaped foam patterns further comprise internal edges forming internal gaps, the internal gaps creating a leaf vein appearance in the leaf-shaped pattern images due to an absence of paint application at the internal gaps.

10. The method of claim 1 wherein the roller cover comprises:

a first plurality of diamond shaped foam patterns, each foam pattern an individual diamond with four corners, and a second plurality of diamond shaped foam patterns substantially smaller than the first plurality of diamond shaped foam patterns, the first plurality of diamond shaped patterns positioned adjacent, but not touching, each other to form aligned rows and columns with gaps between adjacent corners, such that substantially diamond shaped spaces are formed between the individual diamonds of the first plurality of diamond shaped foam patterns, with the second plurality of diamond shaped foam patterns interposed in the substantially diamond shaped spaces leaving uniform gaps between the first plurality and second plurality of diamond shaped foam patterns, the first and second plurality of diamond shaped foam patterns creating diamond shaped pattern images on the finish of the surface with the decorative treatment having an appearance of falling diamonds.

11. The method of claim 1 wherein step c) further comprises selectively applying pressure to the roller cover to cause selected individual images to be more opaque than other individual images on the finish of the surface.

12. The method of claim 11 wherein the pressure is varied as the handle is moved in the discrete motion such that the resulting images vary between substantially opaque and substantially translucent.

13. The method of claim 1 wherein the foam is an open-celled foam.

14. The method of claim 13 wherein the foam is a flexible urethane foam.

15. The method of claim 14 wherein the foam has a density of about 5 pounds per cubic foot.

16. The method of claim 1 wherein the foam pattern thickness ranges from about 0.25 to about 0.5 inches.

17. The method of claim 1 wherein the roller cover further comprises a core having a length and a diameter, the core being attached to the individual raised foam patterns.

18. The method of claim 1 wherein the discrete motions of step c) comprise the sub-steps of:

1) placing the roller cover in contact with the surface, 2) rolling the roller cover across the surface in a generally straight line for a limited distance, 3) removing the roller cover from contact with the surface, 4) placing the roller cover in contact with the surface again in one of a different place and orientation, and 5) repeating steps 2) through 4) until a desired decorative treatment is achieved.

19. The method of claim 18 wherein step 4) comprises placing the roller in contact with the surface again in another of a different place and orientation.

20. The method of claim wherein step 4) comprises placing the roller in contact with the surface again in both a different place and a different orientation.

21. The method of claim 1 wherein the coating is paint.

22. The method of claim 1 wherein at least some of the plurality of individual foam patterns differ in size from other of the plurality of individual foam patterns.

23. The method of claim 1 wherein at least some of the plurality of pattern images vary in opacity within a single image.

24. The method of claims wherein the finish of the surface is at least partially visible through at least a portion of the plurality of pattern images.

25. The method of claim 3 wherein the at least two coating materials comprise a first volume of a first coating provided in a container that is accessible by the paint applicator roller and at least one second volume of at least one second coating material, wherein the at least one second volume is smaller than the first volume, the at least one second coating material being drizzled into the first coating material within the container.

26. The method of claim 11 wherein the pressure is varied as the handle is moved in the discrete motions to cause selected individual pattern images to be more fully formed than other individual images.

27. A method for creating a decorative treatment of falling leaves that gives the illusion of depth to a surface, the method comprising the steps of:

a) providing a paint applicator roller including a handle and a rotatable paint roller cover having a plurality of individual raised foam leaf-shaped patterns thereon that are sized, shaped and positioned to substantially circumscribe the roller cover, each foam leaf-shaped pattern having clearly defined edges along its periphery and an outer surface with the foam patterns circumferentially spaced apart, the patterns formed from open-celled flexible urethane foam having a density of about 5 pounds per cubic foot;

b) loading the foam leaf-shaped patterns of the paint applicator roller with at least one coating material having at least one different visually perceptible characteristic than a finish of a surface to be treated; and c) applying the coating material to the finish of the surface as a plurality of partially overlapping, individual, leaf-shaped pattern images that leave the finish of the surface at least partially visible, by rolling the roller cover across the finish of the surface to contact the finish of the surface with the foam leaf-shaped patterns while the handle is moved in a plurality of partially overlapping, discrete motions, with at least some of the plurality of leaf-shaped pattern images being substantially fully formed on the finish of the surface to correspond in shape and size to the outer surfaces of the foam leaf-shaped patterns on the roller cover and at least some of the plurality of leaf-shaped pattern images being partially formed on the finish of the surface, the plurality of leaf-shaped pattern images creating a decorative treatment on the finish of the surface having the appearance of falling leaves that gives an illusion of three-dimensional depth to the finish of the surface.

28. The method of claim 27 wherein each foam leaf-shaped pattern further comprises internal edges forming internal gaps, the internal gaps creating a leaf vein appearance in the leaf shaped pattern images due to an absence of paint application at the internal gaps.

* * * * *

UNITED STATES PATENT AND TRADEMARK OFFICE

CERTIFICATE OF CORRECTION

PATENT NO. : 6,251,480 B1
DATED : June 26, 2001
INVENTOR(S) : Susan A. Jackson

It is certified that error appears in the above-identified patent and that said Letters Patent is hereby corrected as shown below:

Column 9,
Line 45, after "claim" insert -- 19 --

Signed and Sealed this

Second Day of April, 2002

*Attest:*

*Attesting Officer*

JAMES E. ROGAN
*Director of the United States Patent and Trademark Office*